US008205319B1

(12) United States Patent
Dunn et al.

(10) Patent No.: US 8,205,319 B1
(45) Date of Patent: Jun. 26, 2012

(54) TWO PIECE CORNER FRAMING ELEMENT FOR SWIMMING POOL EXTRUSIONS WITH POOL-LINER ANCHOR CHANNELS

(76) Inventors: David Dunn, Farnborough (GB); Harry J. Last, Koohoo, HI (US)

( * ) Notice: Subject to any disclaimer, the term of this patent is extended or adjusted under 35 U.S.C. 154(b) by 0 days.

(21) Appl. No.: 13/306,912

(22) Filed: Nov. 29, 2011

(51) Int. Cl.
*B23P 11/00* (2006.01)

(52) U.S. Cl. ..... 29/525.01

(58) Field of Classification Search ..... 29/525.01, 29/525.02, 557, 428, 453, 469; 4/502, 496, 4/498, 503; 16/272; 52/300
See application file for complete search history.

(56) References Cited

U.S. PATENT DOCUMENTS

| | | | | | |
|---|---|---|---|---|---|
| 4,577,352 | A * | 3/1986 | Gautheron | ..... | 4/499 |
| 4,939,798 | A * | 7/1990 | Last | ..... | 4/502 |
| 4,967,424 | A * | 11/1990 | Stegmeier | ..... | 4/496 |
| 5,799,342 | A * | 9/1998 | Last | ..... | 4/502 |
| 5,950,253 | A * | 9/1999 | Last | ..... | 4/502 |

* cited by examiner

*Primary Examiner* — John C Hong
(74) *Attorney, Agent, or Firm* — David E. Newhouse, Esq.

(57) ABSTRACT

An two-piece, corner framing element is described for connecting two longitudinal swimming pool extrusions having longitudinal pool-liner channels that utilizes the conventional upward projecting liner-anchoring land along a bottom front edge of the pool-liner channels for angularly orienting and securing the longitudinal extrusions together in the field for framing a corner structure for pool walls as a pool is being constructed.

2 Claims, 11 Drawing Sheets

TWO PIECE CORNER FRAMING ELEMENT FOR SWIMMING POOL EXTRUSIONS WITH POOL-LINER ANCHOR CHANNELS

BACKGROUND OF THE INVENTION

1. Field of the Invention

Corner framing structures are described for connecting two longitudinal swimming pool extrusions having longitudinal pool-liner anchor channels and, in particular an improved two-piece corner framing element for receiving, angularly orienting, and securing longitudinal extruded pool liner-cover track extrusions for framing square corners in the field during pool construction.

2. Description of the Prior Art

Pool liner channels are typically integrated into pool coping extrusions and/or automatic pool cover track channel extrusions or both. (See Cinderella, Inc., 2009 *Aluminum Coping Profile Catalogue & Price List*, pp. 2-3 & 20-22; U.S. Pat. No. 6,496,990, Last, FIG. 8b, & Col. 9, 11. 52-62; & U.S. Pat. No. 7,114,297 Mathis et al, FIGS. 4 & 8.) In fact, a single extrusion may include an upward extending pool coping above an automatic pool cover track channel and a bottom pool liner channel. (Cinderella, Inc., 2009 *Aluminum Coping Profile Catalogue & Price List*, Page 23.)

Joining pool coping, pool-liner and combined pool-liner cover track extrusions at the corners of pools in the field is notoriously tricky to accomplish. Because of this difficulty in field construction, the pool construction industry has resorted to prefabricating pool corners with extrusions legs in the shop, and then supplying both prefabricated corner pieces and longitudinal extrusions pieces for assembly and incorporation into the pool walls. Such prefabricating pool corner extrusion pieces are relatively expensive compared to the cost of longitudinal extrusions pieces.

In addition, prefabrication of corner pieces in many instances is accomplished by bending existing extrusion using specially designed bending machines and/or notching to avoid deformation of the extrusion channels and curved coping elements as the extrusions are bent.

In U.S. Pat. No. 7,114,297, Mathis et al suggest a method for installing a modular corner piece (actually a plate with cornering side edges and a curved, pool side-edge for joining the side edges having a pool-liner anchor channel where the cornering side edges of the plate are pressed into the pool-liner anchor channels of two intersecting pool coping extrusions and fastened to form a corner where the corner piece pool-liner anchor channel aligns with those of the extrusions. (See Col. 5, 11. 50-65 & Col. 6, 11.12-25.) However, while innovative, simply pressing a corner plate into pool-liner anchor channels of intersecting swimming pool extrusions does not assure a precise or 'square' corner. For precision or an assured 'square' corner, the corner plate and extrusions must be pre-assembled and securely fastened together, i.e. must be pre-fabricated with extrusions legs in the shop. Also, Mathis et al ignore the complication that swimming pool extrusions with pool-liner anchor channels that secure vinyl pool liners around the tops of pool walls necessarily include short longitudinal, upward projecting lands defining a bottom lip at the opening of the liner channel that mechanically captures and anchors the 'beaded' or seamed side edge of the pool liner within the pool-liner channel of the extrusion.

SUMMARY OF THE INVENTION

An two-piece, corner framing element is described for connecting two longitudinal swimming pool extrusions having longitudinal pool-liner channels that utilizes the conventional upward projecting liner-anchoring land along a bottom front edge of the pool-liner channels for angularly orienting and securing the longitudinal extrusions together in the field for framing a corner structure for pool walls as a pool is being constructed. In particular, the two-piece corner framing element for swimming pool extrusions comprises a bottom plate and a top plate that when fastened together, orient and hold extrusions for framing a corner at the top of a pool, and provide a curved pool-liner channel aligned with the pool-liner channels of the extrusions before a pour of a concrete/gunnite forming the pool walls, and/or pour of concrete foundation decking surrounding a pool. A conventional electrical drill and a drill jig is utilized to router off the respective sections of the upward projecting liner-anchoring lands of the extrusions that cross through the corner pool-liner anchor channel of the corner framing element before final assembly of the corner framing element and the respective extrusions for framing a pool corner.

The primary novel features of the improved corner framing element relate to the configuration of the cooperating bottom and top surfaces respectively of the top and bottom plates which can be easily, and inexpensively manufactured using conventional injection molding, forming and/or machining methods depending on the materials selected for each particular piece. Further, the mating surfaces of the top and bottom plates of the improved corner framing element can be easily optimally shaped and secured together using standard engineered fasteners for providing a durable corner pool-liner anchor channel that, in addition, is amenable to, and facilitates removal of a damaged pool liner by simply unfastening the top plate from the bottom plate and exposing the pool-liner anchor channel to allow sections of the beaded edge of the pool liner to be pulled out the pool-liner channels of the longitudinal extrusions framing around the pool.

The primary advantage of the improved corner framing element is that it affords installation convenience in the field where pool design constraints mandate precise corners, e.g., where in-wall longitudinal swimming pool extrusions include an automatic pool cover track channel above the pool-liner anchor channel to accommodate an automatic pool cover system that requires rectangular pool walls with (90°) corners.

DESCRIPTION OF PREFERRED AND EXEMPLARY EMBODIMENTS

Figure 6:
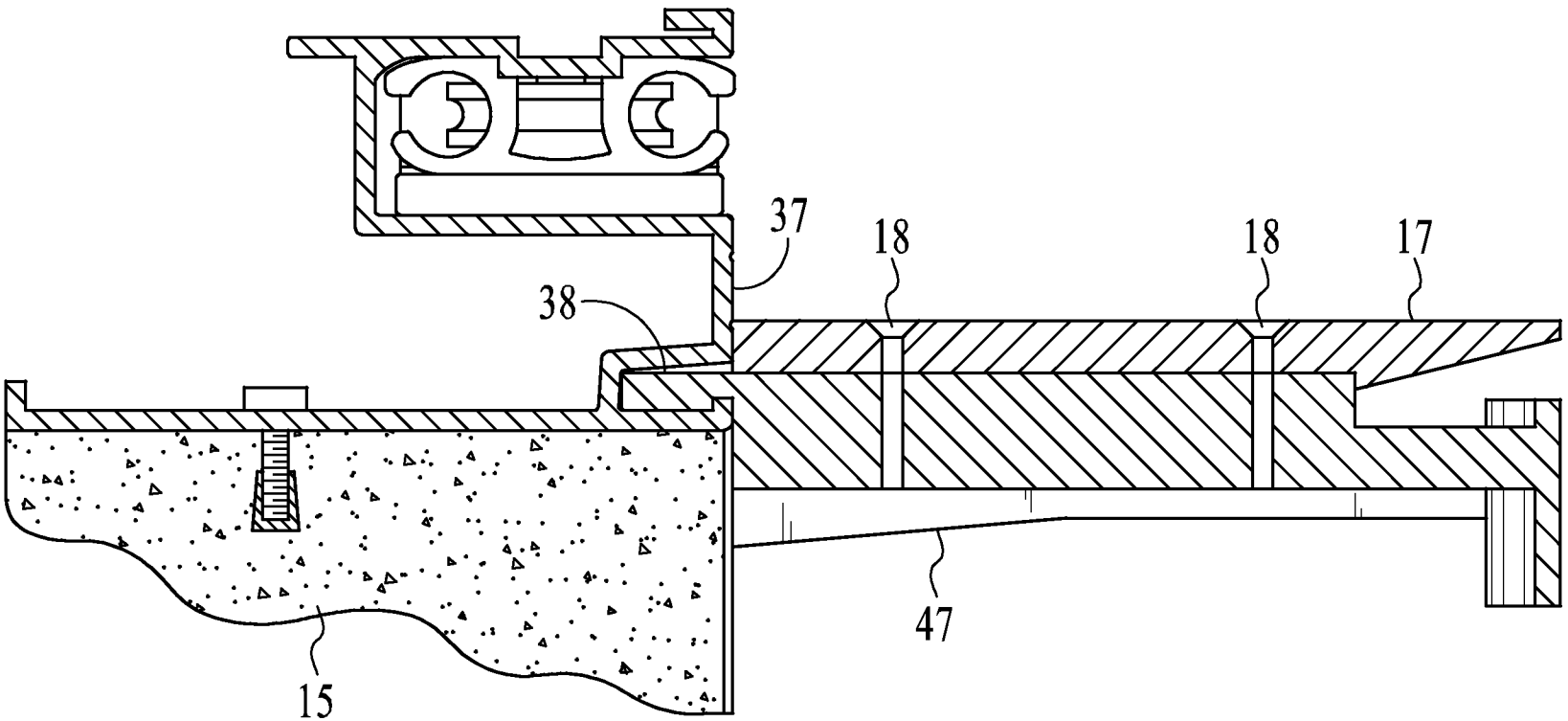
FIG. 6 shows a vertical cross-section view of an embodiment of the improved corner element assembled with an in-wall swimming pool extrusion having a pool-cover channel above a pool-liner channel shown in FIG. 1 where the bottom plate of the element has one or more vertical reinforcing ribs extending downward from its bottom surface.
Figure 13:
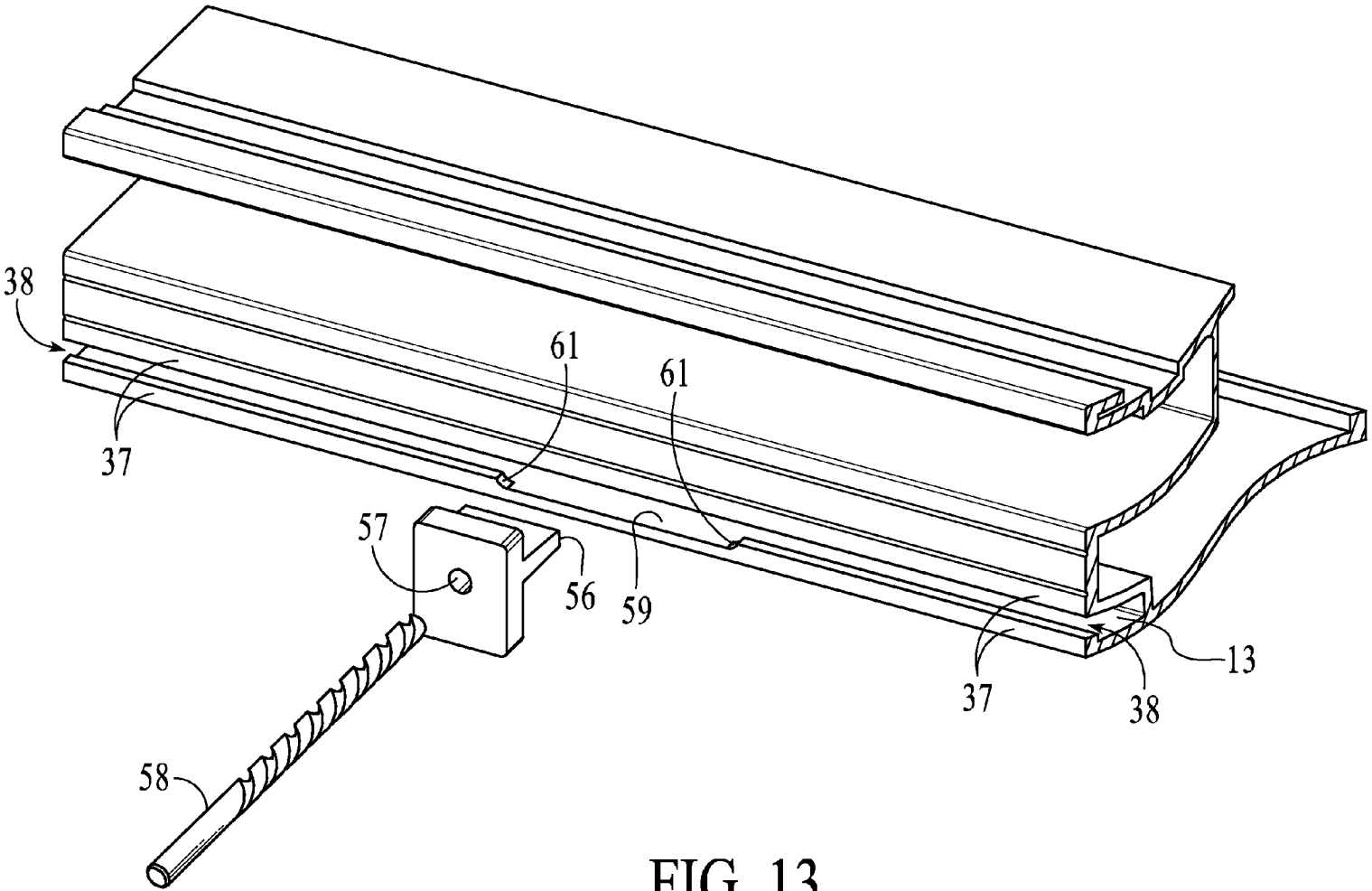
FIG. 13 is a perspective rendering illustrating the relationship of a pool-liner channel of an in-wall pool cover and pool-liner channeled extrusion, and the drill bit, and drill jig shown in FIG. 12.

With reference to FIGS. 1-8 the two-piece, corner framing element 11 for coupling two longitudinal in-wall, pool cover and pool-liner channeled swimming pool extrusions 12*a* and 12*b* at an end of a swimming pool (not shown) opposite an automatic pool cover system (also not shown) comprises a bottom plate 16 and a top plate 17 that, when assembled with the extrusions 12*a* & 12*b*, and fastened together with conventional engineered fasteners 18, securely frame a top corner of the swimming pool before and during a pour of a concrete deck foundation surrounding the pool walls 15 (See FIG. 6 & U.S. Pat. No. 6,496,990, Last, FIGS. 6 & 13 & col. 5, 11.48-65.) Once cured, the concrete deck foundation permanently secure the extrusions 12*a* & 12*b* in place forming a pool corner as framed by the corner framing element 11 with the cooperating adjacent surfaces of the bottom and top plates 16 & 17 of the corner framing element 11 providing a desired, convex, smoothly curved, corner pool-liner channel 19 with a conventional upward projecting liner-anchoring land 21 along the bottom, front edge of the corner channel 19 aligned with the pool-liner channels 13 of the extrusions 12*a* &12*b*. (See FIG. 6).

In more detail, looking at FIGS. 2-7, the bottom plate 16 of the corner framing element 11 has a top face 22, a bottom face 23, straight planar side-edges 24 defining a 90° corner and a planar concave, curved inside, side-edge 26 crossing between the straight side edges 24. The top face 22 of the bottom plate 16 presents a planar surface with a depending, concave, a curved liner-relief 28 spaced inward from, and parallel to the concave curved inside side-edge 26 of the plate conforming in width and depth to the cross-sectional width and base height of an extrusion pool-liner channel 13 to provide an upward projecting, curved liner-anchoring land 21 at the curved planar inside side-edge 26 of the bottom plate 11. The bottom face 23 of the bottom plate 11 presents shoulder reliefs 29 with planar vertical faces 27 cut into the face 23 with a deeper base slot 31 along, and parallel to the respective straight side edges 24 of the bottom plate 16 that provide extending side shoulders 32 sized for snugly sliding longitudinally within the pool-liner channels 13 of the extrusions 12*a* &12*b* with the deeper base slot 31 receiving the upward projecting liner-anchoring land 14 along the bottom front edges of the respective pool-liner channels 13.

The top plate 17 has a bottom seating face 33 sized for seating on the top face 22 of the bottom plate 16 with straight planar side-edges 34 conforming to a 90° corner, and a concave, curved inside side-edge 36, conforming to the curved inner side-edge 26 of the bottom plate 11. When seated and fastened on the bottom plate 11, the planar side edges seat 34 on vertical side surfaces 37 (FIG. 6) of the respective longitudinal extrusions 12*a* &12*b* above the entrant slots 38 of the pool-liner anchor channels 13. At the curved, inner side-edge 34, the bottom surface 39 of the top plate 17 presents an inclined surface 41 tapering upward from a seating shoulder 35 toward the curved edge 36 of the top plate 17. The seating shoulder 35 projects down from the seating face 33 of the top plate and seats on the back shoulder 44 of the curved liner-relief 28 in the top face 22 of the bottom plate 16 for corporately providing a corner pool-liner channel 19.

Figure 1:
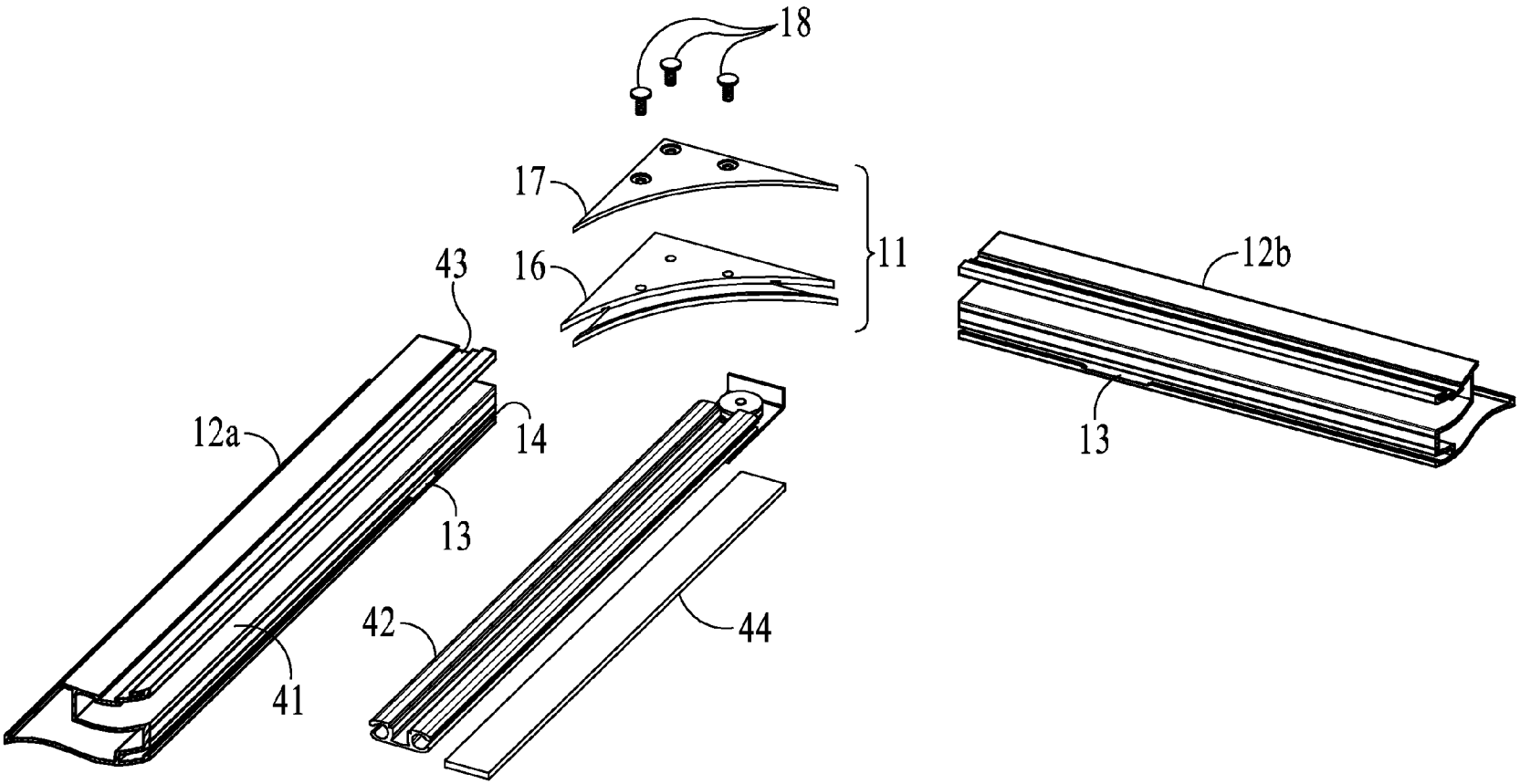
FIG. 1 is an exploded perspective view of the improved corner framing element and typical in-wall swimming pool extrusions having a pool-cover channel above a pool-liner channel, a distal end of an extruded pool cover track with end pulley, and a longitudinal spacer plate that secures the pool cover track in the pool-cover channel of the extrusion.
Figure 2:
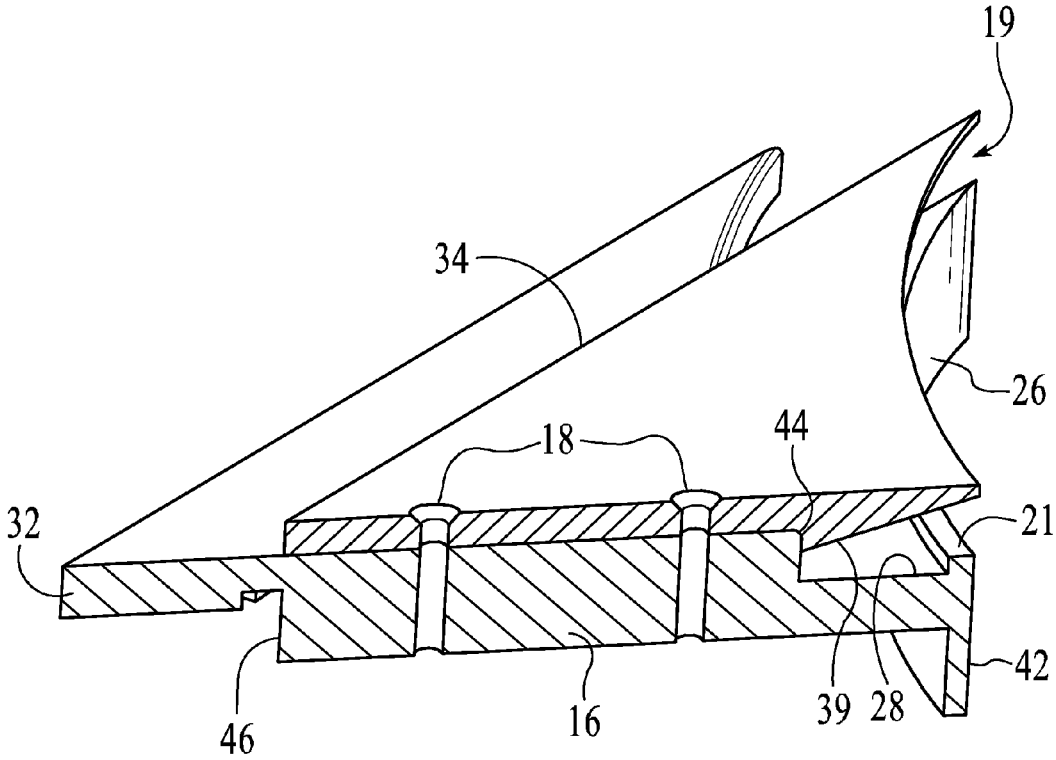
FIG. 2 shows a perspective view of a cross section of an embodiment of the improved corner framing element only, with the top plate seated on the bottom plate of the element.
Figure 3:
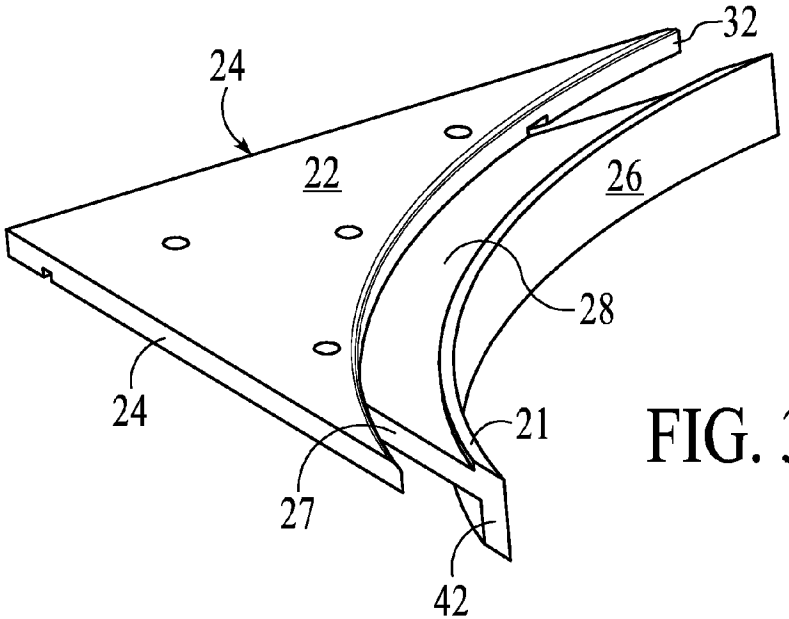
FIG. 3 is perspective view of the top surface of the bottom plate of the embodiment of the improved corner framing element shown in FIG. 2.
Figure 4:
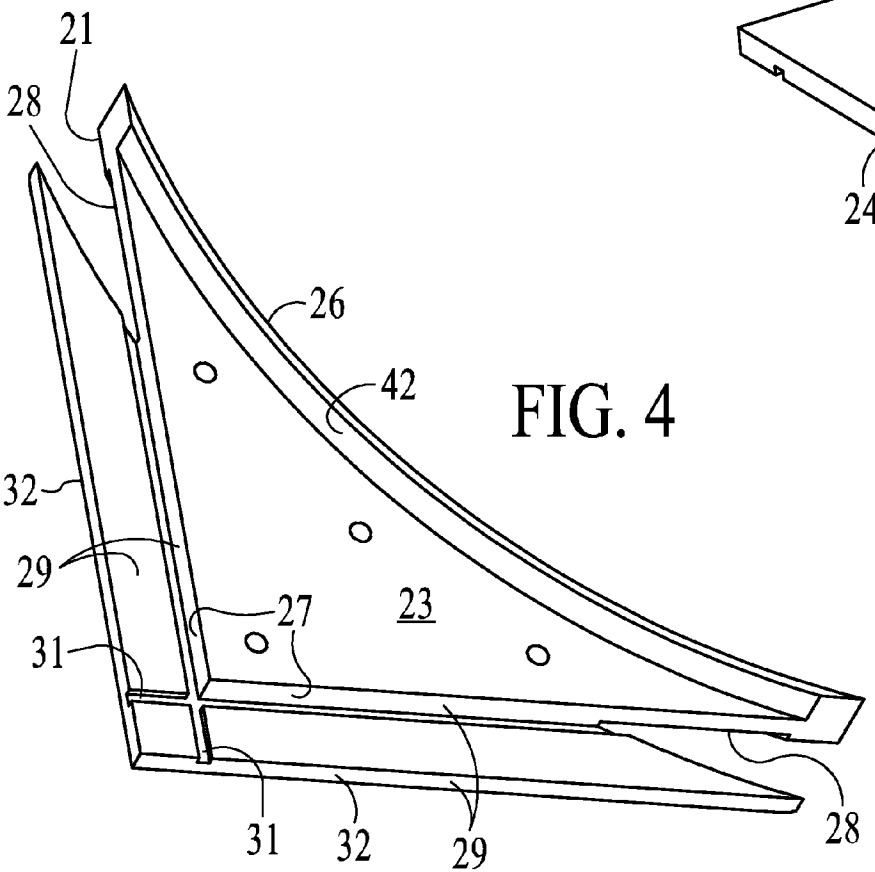
FIG. 4 is perspective view of the bottom surface of the bottom plate of the embodiment of the improved corner framing element shown in FIG. 2.
Figure 5:
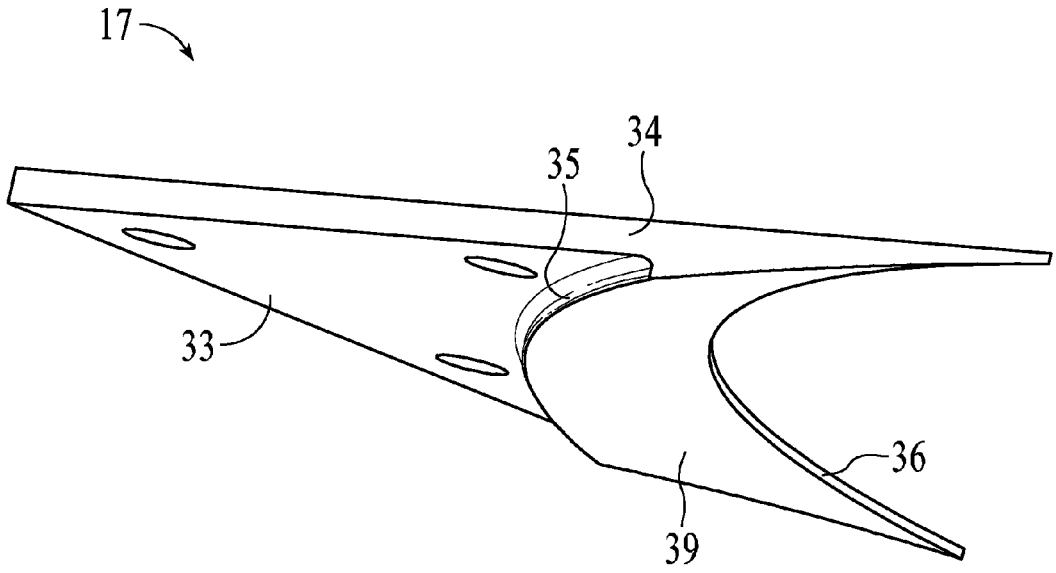
FIG. 5 is perspective view of the bottom face of the top plate of the embodiment of the improved corner framing element shown in FIG. 2.
Figure 7:
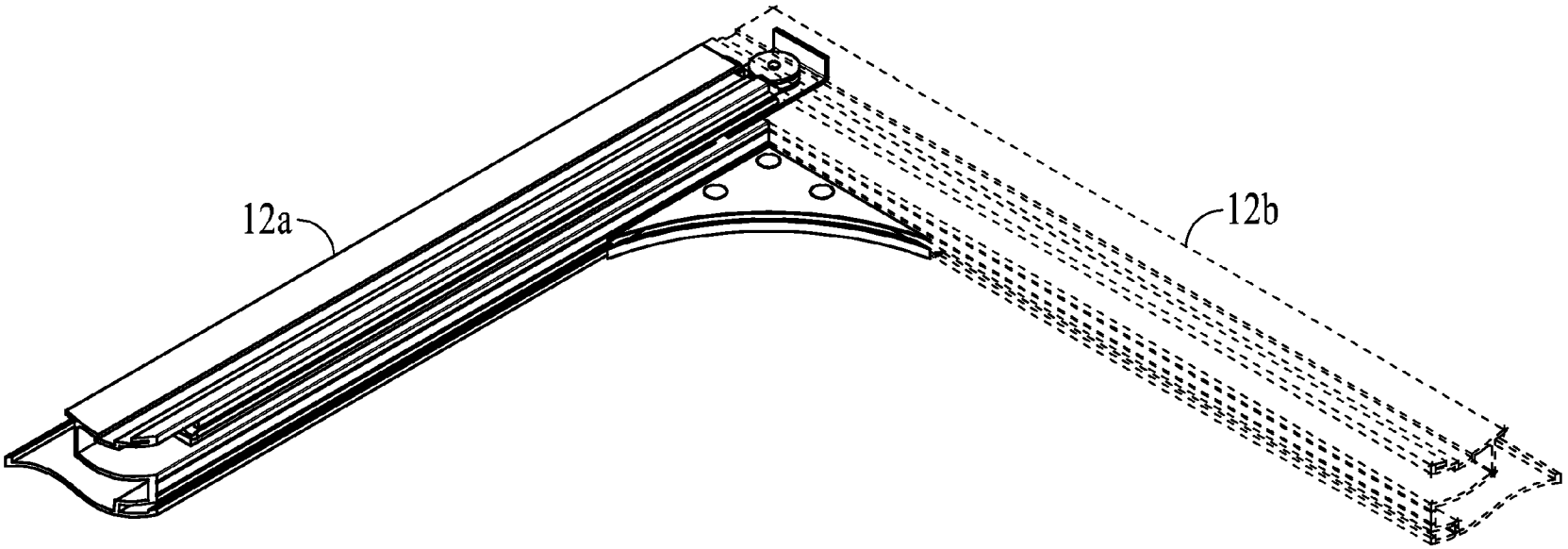
FIG. 7 is an assembled perspective view of the improved corner framing element and the swimming pool extrusions shown in FIG. 1 for framing a 90° corner of a swimming pool.

The longitudinal swimming pool extrusions 12*a* & 12*b* shown in FIGS. 1, 6 & 7 are conventional in-wall, swimming pool extrusion with an automatic pool-cover track channel 41 above a pool-liner channel 13 that present vertical side surfaces 37 above and below an entrant slots 38 into the pool liner channel 13. A conventional pool-cover track extrusion 42 is received in the pool-cover track channel 41 of extrusion 12*a* and anchored between a longitudinal land 43 depending down from the top of the channel 41 and a longitudinal spacer plate 44 is inserted into the channel 41 beneath the pool-cover track extrusion 42. Extrusion 12*b* crosses the pool end, houses end pulleys at distal ends of the pool cover track extrusions 42 on the opposite sides of the pool (See U.S. Pat. No. 6,496,990, Last, FIG. 7a) As illustrated in FIGS. 2 & 6 showing a cross-section of the different embodiments of the corner framing element 11*a* vertical support face 46 of the shoulder relief 29 that extends down into the deeper base slots 31, seats on the vertical facing surface 37 of the extrusions 12*a* & 12*b* below the entrant slots 38 of the pool-liner channels 13 of the extrusions, i.e., on the vertical outside face of the liner anchoring land 14. However, to provide additional mechanical support to the resulting corner structure 11, as portrayed in FIG. 6, the bottom face 23 of the bottom plate 16 of the corner framing element 11, may include one or more vertical reinforcing ribs 47 for providing vertical support surfaces 48 to the corner framing element 11 that extend downward below the extrusion 12*a* to seat on the pool wall 15 below the respective extrusions 12*a* & 12*b*. This latter embodiment of the improved corner element 11 would be particularly suited for pool-liner swimming pools that do not provide an underlying curved wall support underneath, the concave, curved inside, side-edge 26 of the corner framing element 11.

Figure 8:
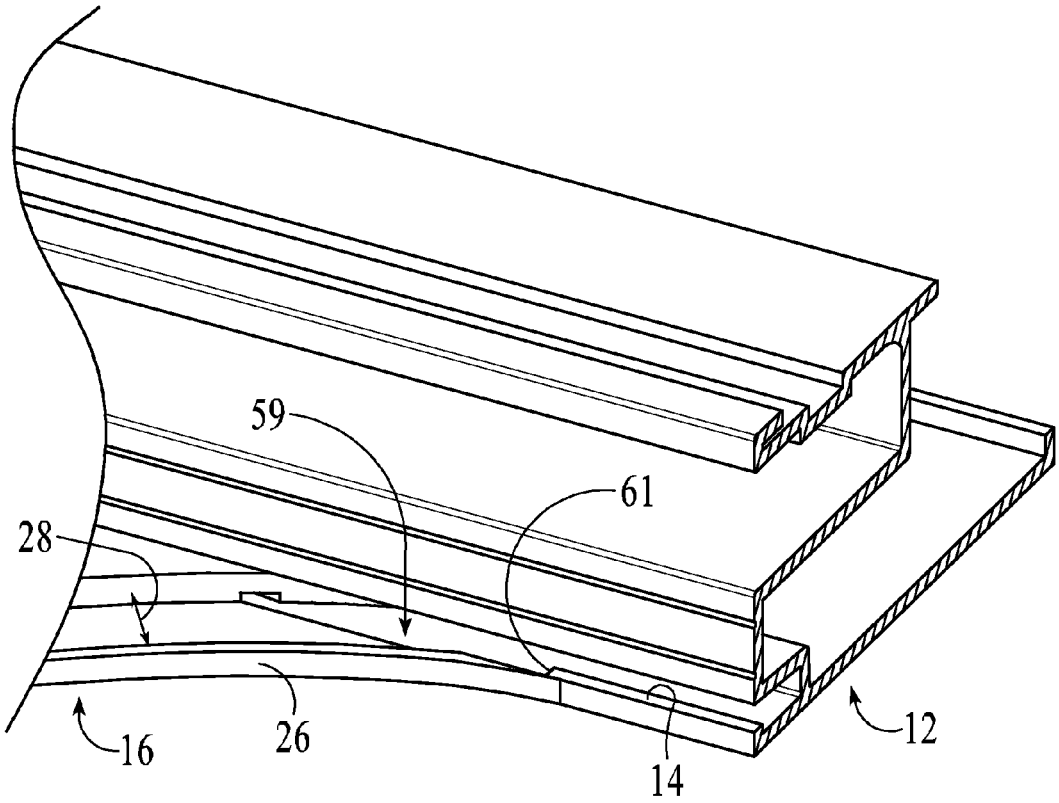
FIG. 8 is an enlarge perspective view of a portion the top surface of the bottom plate of the improve corner framing element showing the intersection of the curved liner-relief channel and a removed section of the upward projecting liner-anchoring land along the bottom edge of the pool-liner anchor channels of a swimming pool extrusion.

FIG. 8, shows removed section of the upward projecting liner-anchoring land 14 of a particular extrusion 12 that would cross through the concave, a curved liner-relief 28 depending into the top face 22 of the bottom plate 16 of the corner framing element 11. In more detail, jumping to FIGS. 12 and 13, a drill jig 51 is shown that has a seating face 52 configured for seating on the side surfaces 37 of the particular extrusion 12 (FIG. 13) on either side of the entrant slot 38 of its pool-liner channel 13 with a wider nose 56 that perpendicularly extends through the entrant slot 38 into the pool-liner channel 13 for locating a guide hole 57 drilled through the drill jig 51 that intersects with the upward projecting liner-anchoring land 14 at the bottom front edge of the pool-liner channel 13 when the drill jig 51 is seated for sliding longitudinally on the side surfaces 37 of the extrusion 12. The guide hole 57 receives and guides an appropriately sized drill bit 58 driven by an electrical hand drill (not shown) to router away the upward projecting liner-anchoring land 14 as the drill jig 51 is slid longitudinally along and within the entrant slot 38 of the pool-liner channel 13.

Figure 12:
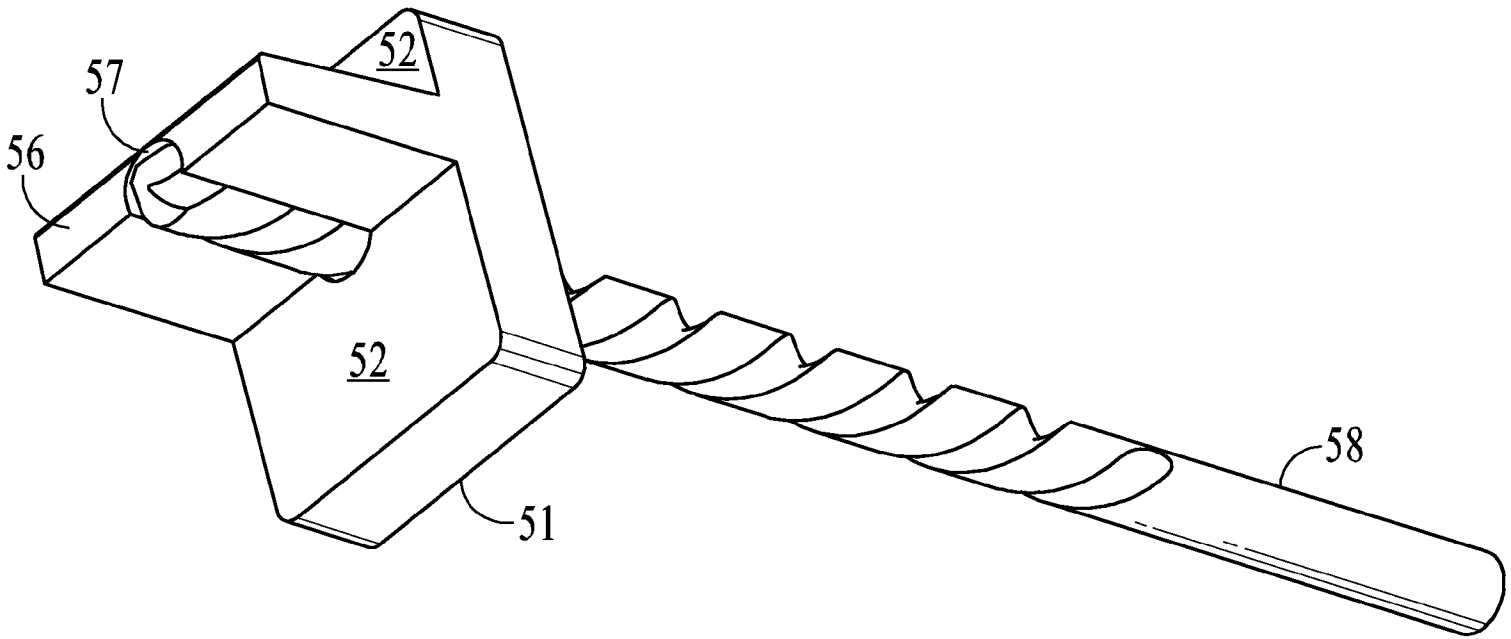
FIG. 12 shows a perspective view of a drill bit and a drill jig for routering off the respective sections of the upward projecting liner-anchoring lands of the pool-liner channel of the extrusions that would cross the curved liner-relief channel of the improved corner framing element when assembled with the extrusions for framing the corner.

In particular, with reference to FIG. 12 the diameter of the guide hole 57 should be slightly greater than that of the drill bit 58 and necessarily less than the height of the pool-liner channel 13. The radius of the drill bit 57 is appropriately sized to be substantially greater than the height of the upward projecting liner-anchoring land 14. The guide hole 56 positions the drill bit 57 when the drill jig 51 is seated such that the drill bit 57 only routers off the upward projecting liner-anchoring land 14 above the bottom floor 59 of the pool-liner channel 13 leaving concave end surfaces 61 that curve upward from the floor 59 of the pool-liner channel 13 having radiuses substantially greater than the height of the land 14.

The particular sections of the liner-anchoring lands 14 of the particular extrusions 12 for removal can easily be determined by measurement, and marked. Alternatively, the framing extrusions 12 can be assembling with the bottom plate 16 in the field, the intersecting sections the of the liner-anchoring lands 14 marked, whereupon the pieces are disassembled. In either instance the marked sections of the liner-anchoring lands 14 on the respective extrusions 12 can be easily removed as describe above with described drill jig 51 and drill bit 57.

Figure 9:
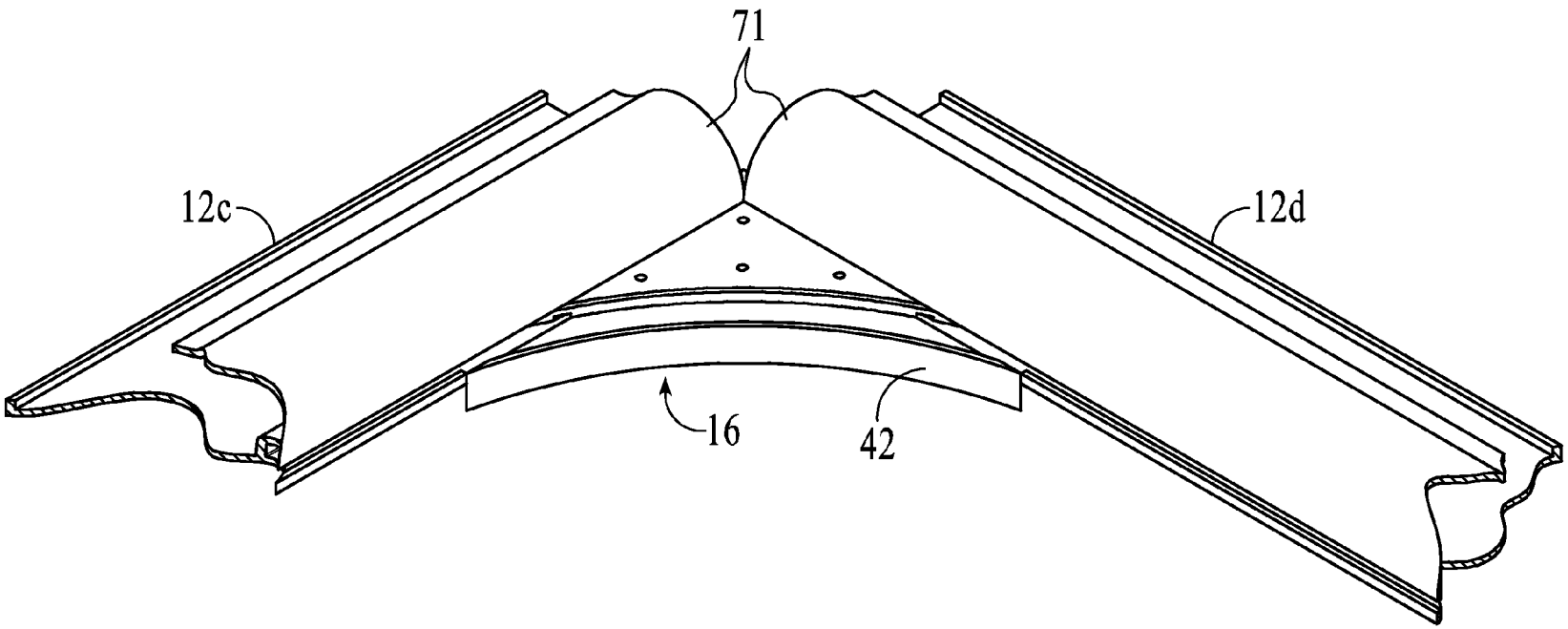
FIG. 9 is an assembled perspective view of two swimming pool liner extrusions with copings assembled with the bottom plate of the improved corner framing element for framing a 90° corner of a swimming pool.
Figures 10, 11:
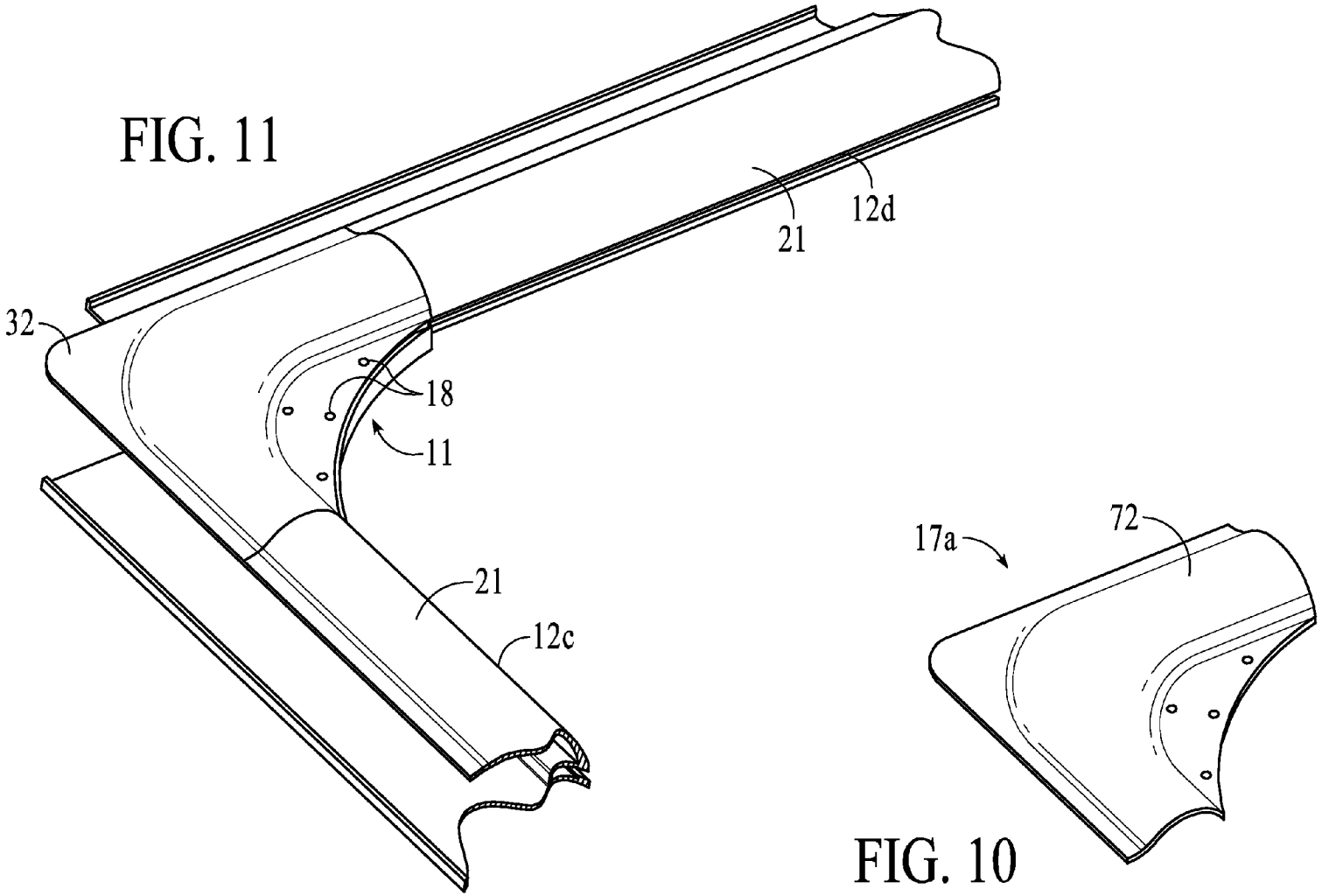
FIG. 10 shows a top perspective of a top plate formed with an integral top corner coping structure for accommodating the ends of the framing extrusions of FIG. 9.
FIG. 11 shows a perspective of the assembled corner shown in FIG. 10 with the formed top plate of FIG. 10.

FIGS. 9-11, illustrate an embodiment of the improved corner framing element 11 for coupling two longitudinal swimming pool extrusions 12*c* & 12*d* with longitudinal pool-liner channels 13 below coping structures 71. FIG. 9 shows the extrusions 12*c* & 12*d* assembled with the bottom plate 16 of the corner framing element previously described with reference to FIGS. 2-7, supra. FIG. 10 shows a top plate 17*a* that is integrally formed with a corner coping structure 72 that extends above the pool surface to integrate with a surrounding pool deck foundation (not shown) and joins or covers over the cornering coping ends of the extrusions 12*c* & 12*d* (FIG. 10) obviating any necessity for precise mitering at the junction ends of the extrusions 12*c* &12*d* framing the pool corner.

Those skilled in the injection molding arts should note and appreciate that, as illustrated in FIG. 2, that the planer concave, curved inside, side-edge 26 of the bottom plate 16 crossing between the straight side edges 24 may be strengthened by providing a downward extending apron or land 42 along the curved inside, side-edge 26 of the bottom plate 16. Further, rounding the back corner shoulder 44 of the depending curved liner relief 28 to receive a correspondingly concave, rounded shoulder 35 (FIG. 5) depending down from the bottom seating face 33 of the top plate 17 increases both the integrity and effectiveness of the corner liner channel 19. Further, skilled injection mold designers can easily provide addition structural features on the bottom face 23 of the bottom plate 16 adapting it to seat for support on a particular underlying curved, corner-wall panel for each the different pool-wall panel structural systems of existing commercial in-ground and above ground liner swimming pools.

The bottom plate may be made of a strong structural material such as aluminum or a resilient inert structural plastic such as UHWM plastic or POM that have high stiffness and excellent dimensional stability using simple machining techniques. The top plate could be formed or injection 12 can be assembling with the bottom plate 16 in the field, the intersecting sections the of the liner-anchoring lands 14 marked, whereupon the pieces are disassembled. In either instance the marked sections of the liner-anchoring lands 14 on the respective extrusions 12 can be easily removed as describe above with described drill jig 51 and drill bit 57.

FIGS. 9-11, illustrate an embodiment of the improved corner framing element 11 for coupling two longitudinal swimming pool extrusions 12*c* & 12*d* with longitudinal pool-liner channels 13 below coping structures 71. FIG. 9 shows the extrusions 12*c* & 12*d* assembled with the bottom plate 16 of the corner framing element previously described with reference to FIGS. 2-7, supra. FIG. 10 shows a top plate 17*a* that is integrally formed with a corner coping structure 72 that extends above the pool surface to integrate with a surrounding pool deck foundation (not shown) and joins or covers over the cornering coping ends of the extrusions 12*c* & 12*d* (FIG. 10) obviating any necessity for precise mitering at the junction ends of the extrusions 12*c* &12*d* framing the pool corner.

Those skilled in the injection molding arts should note and appreciate that, as illustrated in FIG. 2, the planar concave, curved inside, side-edge 26 of the bottom plate 16 crossing between the straight side edges 24 may be strengthened by providing a downward extending apron or land 42 along the curved inside, side-edge 26 of the bottom plate 16. Further, rounding the back corner shoulder 44 of the depending curved liner relief 28 to receive a correspondingly concave, rounded shoulder 35 (FIG. 5) depending down from the bottom seating face 33 of the top plate 17 increases both the integrity and effectiveness of the corner liner channel 19. Further, skilled injection mold designers can easily provide addition structural features on the bottom face 23 of the bottom plate 16 adapting it to seat for support on a particular underlying curved, corner-wall panel for each the different pool-wall panel structural systems of existing commercial in-ground and above ground liner swimming pools.

The bottom plate may be made of a strong structural material such as aluminum or a resilient inert structural plastic such as UHWM plastic or POM that have high stiffness and excellent dimensional stability using simple machining techniques. The top plate could be formed or injection molded using an inert, UV-resistant plastic, and offers the flexibility of providing a top structural corner coping configurations above the pool surface that integrates with the surrounding pool deck and accommodates the coping ends above the extrusion channel(s) of longitudinal extrusions secured by the improved corner plate obviating any necessity for precise mitering at the junction ends of the extrusions framing the corner.

Further, it should be recognized that skilled engineers and designers can specify different configurations for the described two-piece corner framing element that angularly orients and secures two longitudinal swimming pool extrusions having longitudinal pool-liner channels in the field during pool construction for framing a swimming pool corner and provide a curved corner pool-liner anchor channel aligned with the pool-liner channels of the corner framing extrusions that will perform substantially the same function, in substantially the same way, to achieve substantially the same result as those components described and specified above. Similarly, methods used described for implementing the desired functionality of the invented two-piece corner framing element may differ from those described yet accomplish substantially the same function, in substantially the same way, to achieve substantially the same result as those methods by the Applicants. Accordingly, while mechanical components and methods suitable for implementing the invented improvements may not be exactly described herein, they may fall within the spirit and the scope of invention as described and set forth in the appended claims.

We claim:

1. An improved method for angularly orienting and securing two longitudinal swimming pool extrusions each having a longitudinal pool-liner anchor channel with an upward projecting liner-anchoring land along a bottom front edge defining an entrant slot into the pool-liner anchor channel for framing a desired corner for incorporation into walls of a swimming pool during construction, comprising the steps of:

a) making a bottom plate with top, and bottom faces having straight, planar, intersecting side-edges defining the desired corner and a planar concave-curved pool side-edge crossing between the straight planar intersecting side edges;

b) milling a planar, concave-curved, relief into the top face of the bottom plate spaced inward from, and parallel to the concave curved pool side-edge of the bottom plate having a depth at most equal to the cross-sectional height of the pool liner channels and a width at most equal to the cross-sectional width of the pool-liner anchor channel and providing an upward projecting corner pool-liner-anchoring land at the concave-curved planar pool side-edge of the bottom plate; and c) milling linear side-reliefs into the planar, straight intersecting side-edges of the bottom plate with a deeper base slot for providing extending, side-shoulders with vertical seating faces, the side-shoulders being sized for snugly sliding longitudinally within the respective pool-liner anchor channels of the extrusions with the deeper base slot receiving the upward projecting pool-liner anchoring lands along the bottom front edge of the pool-liner anchor channels with the vertical seating faces of the side-shoulders seated on facing surfaces of the respective swimming pool extrusions below the entrant slots into the pool-liner anchor channels of the swimming pool extrusions;

d) sliding the longitudinal extrusions onto the bottom plate with the respective extending side-shoulders of bottom plate each being received in a pool-liner anchor channel of one of the extrusions to frame the desired corner;

e) removing sections of the upward projecting pool-liner anchoring land of the extrusion pool-liner anchor channels framing the corner that cross the planar, curved liner-relief milled into the top surface of the bottom plate when the extending side shoulders of the bottom plate are received in the swimming pool extrusion pool-liner anchor channels for framing the desired corner;

f) making a top plate having a planar bottom face, and straight planar side-edges defining the corner with a concave-curved pool side-edge, conforming to that of the planar concave-curved pool side-edge of the bottom plate, the top plate being sized to seat on the top face of the bottom plate with its straight planar side-edges seating on facing front surfaces of the respective longitudinal extrusions above the entrant slots into the pool-liner anchor channels of the corner framing swimming pool extrusions and with its concave-curved pool side-edge in vertical registry with the planar concave-curved pool side edge of the bottom plate for providing a corner pool-liner anchor channel aligned with the respective pool-liner channels of the corner framing swimming pool extrusions in combination with the planar, concave-curved, relief milled into the top face of the bottom plate; and g) securing the top plate to the bottom plate.

2. An improved method for angularly orienting and securing two longitudinal swimming pool extrusions each having a longitudinal pool-liner anchor channel with an upward projecting, pool-liner anchoring land along a bottom front edge of the pool-liner anchor channel for framing a desired corner for incorporation into walls of a swimming pool during construction, comprising the steps of:

a) making a bottom plate with planar, straight intersecting side-edges defining the desired corner and a planar concave, curved inside, side-edge crossing between the straight side edges having:

(i) a planar top face with a concave, curved, liner-relief depending into the top face of the bottom plate spaced inward from, and parallel to the concave, curved inside side-edge of the bottom plate having a width at most equal to the cross-sectional width of the pool-liner anchor channel and providing an upward projecting liner-anchoring land along the concave, curved inside side-edge of the bottom plate; and having (ii) a bottom face with side-reliefs depending into the planar, straight, intersecting side-edges of the bottom plate, with deeper base slots providing extending side-shoulders with vertical seating faces, the side-shoulders being sized for snugly sliding longitudinally within the respective pool-liner anchor channels of the extrusions with the deeper base slot receiving the upward projecting liner-anchoring lands along the bottom front edges of the pool-liner anchor channels of the respective longitudinal extrusions and the vertical seating faces of the side shoulders seating on vertical facing surfaces of the extrusions below entrant slots into the pool-liner anchor channels of the swimming pool extrusions;

b) sliding the longitudinal swimming pool extrusions onto the bottom plate with the respective extending side shoulders of bottom plate each being received in a pool-liner anchor channel of one of the extrusions for framing the desired corner;

c) removing sections the upward projecting liner-anchoring lands along the bottom front edges of the pool-liner anchor channels of the corner framing swimming pool extrusions that cross the concave, curved, liner-relief depending into the top surface of the bottom plate; and d) making a top plate having straight, planar intersecting side-edges defining the desired corner and having an inclined surface tapering upward from a seating face toward a concave-curved pool side-edge for providing a curved, corner pool-liner anchor channel in combination with the depending, concave-curved liner-relief in the top face of the bottom plate when seated on the planar top face of the bottom plate aligned with the pool-liner channels of the corner framing swimming pool extrusions angularly, the top plate being sized for seating on the planar top face of the bottom plate with its planar intersecting side-edges seating on facing vertical surfaces of the respective longitudinal swimming pool extrusions above entrant slots into the pool-liner anchor channels and with its concave-curved pool side-edge vertically above and registering with the planar, concave-curved pool side-edge of the bottom plate and;

e) securing the top plate to the bottom plate.

* * * * *